US010183829B2

(12) United States Patent
Tokuma

(10) Patent No.: US 10,183,829 B2
(45) **Date of Patent: *Jan. 22, 2019**

(54) SHEET STACKING APPARATUS AND IMAGE FORMING APPARATUS

(71) Applicant: CANON KABUSHIKI KAISHA, Tokyo (JP)

(72) Inventor: Naoto Tokuma, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/878,637

(22) Filed: Jan. 24, 2018

(65) Prior Publication Data

US 2018/0155146 A1 Jun. 7, 2018

Related U.S. Application Data

(63) Continuation of application No. 15/223,130, filed on Jul. 29, 2016, now Pat. No. 9,914,611.

(30) Foreign Application Priority Data

Aug. 4, 2015 (JP) ..... 2015-154275

(51) Int. Cl.
*B65H 29/14* (2006.01)
*B65H 29/24* (2006.01)
(Continued)

(52) U.S. Cl.
CPC ..... *B65H 29/246* (2013.01); *B65H 29/14* (2013.01); *B65H 29/245* (2013.01); *B65H 31/10* (2013.01);
(Continued)

(58) Field of Classification Search
CPC .. B65H 29/245; B65H 29/246; B65H 29/247; B65H 29/248; B65H 2406/121; B65H 2515/212
See application file for complete search history.

(56) References Cited

U.S. PATENT DOCUMENTS 7,283,776 B2 10/2007 Oba
8,577,273 B2 11/2013 Inoue
(Continued)

FOREIGN PATENT DOCUMENTS

JP 2011-057313 A 3/2011
JP 2014-047047 A 3/2014

*Primary Examiner* — Jeremy R Severson
(74) *Attorney, Agent, or Firm* — Venable LLP

(57) ABSTRACT

A sheet stacking apparatus includes a discharging portion including a nip portion nipping and conveying a sheet, a stacking portion on which the sheet discharged by the discharging portion is stacked, an air blowing unit configured to blow air toward a lower face of the sheet being discharged by the discharging portion, and an air volume control portion configured to control the air blowing unit such that a volume of the air blown by the air blowing unit is switched from a first air volume to a second air volume which is smaller than the first air volume while the nip portion of the discharging portion is nipping and conveying the sheet to set the volume of the air to the second air volume in a case where a trailing end of the sheet discharged by the discharging portion passes through the nip portion.

19 Claims, 13 Drawing Sheets

(51) Int. Cl.

| | |
|---|---|
| ***B65H 43/00*** | (2006.01) |
| ***B65H 31/10*** | (2006.01) |
| ***B65H 31/38*** | (2006.01) |

(52) U.S. Cl.

CPC ..... *B65H 31/38* (2013.01); *B65H 43/00* (2013.01); *B65H 2301/4461* (2013.01); *B65H 2404/14* (2013.01); *B65H 2406/121* (2013.01); *B65H 2406/122* (2013.01); *B65H 2511/22* (2013.01); *B65H 2513/53* (2013.01); *B65H 2515/112* (2013.01); *B65H 2515/212* (2013.01); *B65H 2557/242* (2013.01); *B65H 2801/06* (2013.01)

(56) References Cited

U.S. PATENT DOCUMENTS

| | | | | |
|---|---|---|---|---|
| 8,794,617 | B2 | 8/2014 | Tokuma | |
| 8,851,468 | B2 | 10/2014 | Tokuma | |
| 8,925,917 | B2 | 1/2015 | Watanabe et al. | |
| 9,033,330 | B2 | 5/2015 | Tokuma | |
| 9,067,753 | B2 | 6/2015 | Tokuma et al. | |
| 9,102,497 | B2 | 8/2015 | Tokuma | |
| 9,821,978 | B2 * | 11/2017 | Herrmann ..... | B65H 29/247 |
| 9,914,611 | B2 * | 3/2018 | Tokuma ..... | B65H 29/246 |
| 2009/0169224 | A1 | 7/2009 | Suzuki | |
| 2012/0093555 | A1 | 4/2012 | Obuchi | |
| 2013/0228965 | A1 | 9/2013 | Hoshino et al. | |
| 2014/0062016 | A1 | 3/2014 | Watanabe et al. | |

* cited by examiner

SHEET STACKING APPARATUS AND IMAGE FORMING APPARATUS

This application is a continuation of application Ser. No. 15/223,130, filed Jul. 29, 2016.

BACKGROUND OF THE INVENTION

Field of the Invention

This disclosure is related to a sheet stacking apparatus on which a sheet is stacked, and an image forming apparatus.

Description of the Related Art

Hitherto, a configuration in which a position of a sheet on a stacking tray in a sheet discharging direction is aligned by discharging the sheet on which an image is formed toward the stacking tray and abutting the discharge sheet to an abutment member arranged on the upstream side of the sheet in the sheet discharging direction has been known. In such a configuration, a leading end of a sheet discharged toward the stacking tray (hereinafter, described as "discharge sheet") comes into contact with a sheet already stacked on the stacking tray (hereinafter, described as "stacked sheet").

When a leading end of a discharge sheet comes into contact with a stacked sheet, the stacked sheet is easily pushed out to the downstream side of the sheet in the sheet discharging direction. As such a configuration in which pushing-out of a stacked sheet to the downstream side in the sheet discharging direction due to a discharge sheet is prevented, a method of blowing air to a sheet or a stacking tray from the bottom of the discharge sheet is described in JP-A-2014-47047.

In a configuration in which air blowing is performed in order to prevent pushing-out of a stacked sheet due to a discharge sheet, in a case in which a volume of air blown toward a discharge sheet is large, a landing spot of the discharge sheet is easily located on the downstream side of the stacking tray in the sheet discharging direction. In this case, a movement distance of the discharge sheet from stacking to bumping into an abutment member becomes long, a behavior of the discharge sheet becomes unmanageable by being influenced by air blowing, when the discharge sheet moves until bumping into the abutment member, and it is difficult to stack the sheet stably.

In particular, in a sheet, referred to as a long sheet, of which a length in the sheet discharging direction is approximately 700 mm, there is also a concern that the sheet may fall from the stacking tray, since the sheet is easily influenced by air blowing when being discharged, and a landing spot is located on the downstream side, considerably, in the sheet discharging direction.

As a configuration of preventing a landing spot of a discharge sheet from being located on the downstream side in the sheet discharging direction due to air blowing, an apparatus which stops air blowing in the middle of discharging a sheet is described in JP-A-2011-57313. This apparatus blows air to a lower face of a discharge sheet in order to prevent a stacked sheet from being pushed out due to a leading end of the discharge sheet, and stops air blowing immediately before a trailing end of the discharge sheet passes through a discharging roller so that the apparatus prevents a landing spot of the discharge sheet from locating on the downstream side of a stacking tray in the sheet discharging direction.

Here, in general, at a time of discharging a discharge sheet, the stacked sheet is pushed out to the downstream side in the sheet discharging direction due to friction between a lower face of a discharge sheet and a top face of a stacked sheet. Since responsivity of a blower fan which performs air blowing is not so good, in a case of stopping air blowing, an air volume gradually decreases, and air blowing is stopped, finally.

That is, in the apparatus described in JP-A-2011-57313, by gradually decreasing an air volume in the middle of discharging of the discharge sheet in order to stop air blowing, it becomes an air volume in which a lower face of a discharge sheet and a top face of a stacked sheet are subjected to friction contact before a trailing end of the discharge sheet passes through a discharging roller. For this reason, due to friction between the lower face of the discharge sheet and the top face of the stacked sheet, the stacked sheet is pushed out toward the downstream side in the sheet discharging direction.

SUMMARY OF THE INVENTION

According to an aspect of this disclosure, there is provided a sheet stacking apparatus including a discharging portion including a nip portion nipping and conveying a sheet, and configured to discharge the sheet, a stacking portion on which the sheet discharged by the discharging portion is stacked, an air blowing unit configured to blow air toward a lower face of the sheet being discharged by the discharging portion, and an air volume control portion configured to control the air blowing unit such that a volume of the air blown by the air blowing unit is switched from a first air volume to a second air volume which is smaller than the first air volume while the nip portion of the discharging portion is nipping and conveying the sheet to set the volume of the air to the second air volume in a case where a trailing end of the sheet discharged by the discharging portion passes through the nip portion.

Further features of this disclosure will become apparent from the following description of exemplary embodiments with reference to the attached drawings.

DESCRIPTION OF THE EMBODIMENTS

Hereinafter, an image forming apparatus according to an embodiment of this disclosure will be described with reference to drawings. The image forming apparatus according to the embodiment is an image forming apparatus including a sheet processing unit in which it is possible to align a sheet discharged to a stacking portion in a sheet discharging direction such as a copier, a printer, a facsimile, and a multi-purpose peripheral of these. In the embodiment below, an image forming apparatus will be described by using a monochrome/color copier (hereinafter, referred to as "copier") 1000.

Figure 1:
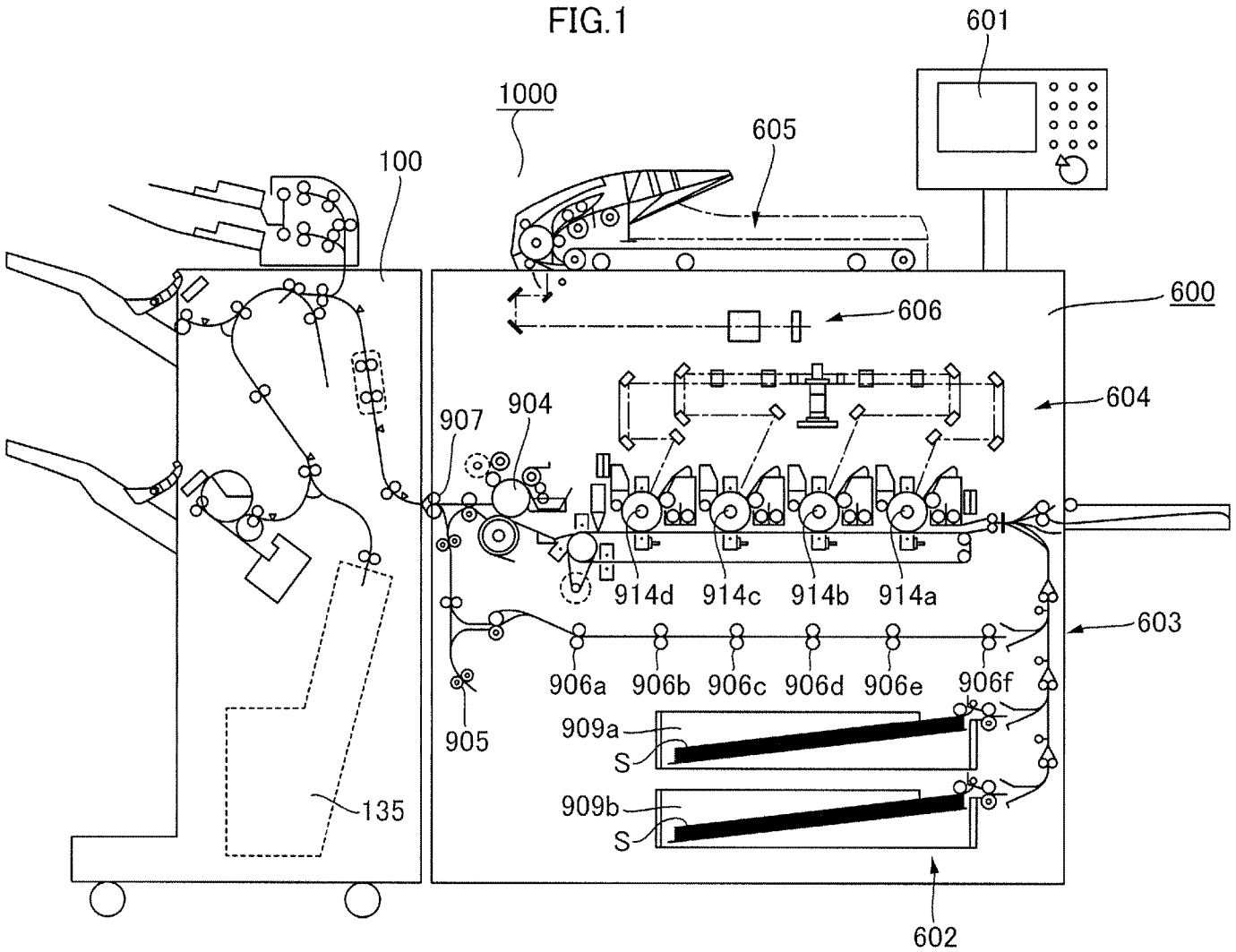
FIG. 1 is a schematic diagram illustrating an image forming apparatus according to an embodiment.
Figure 2:
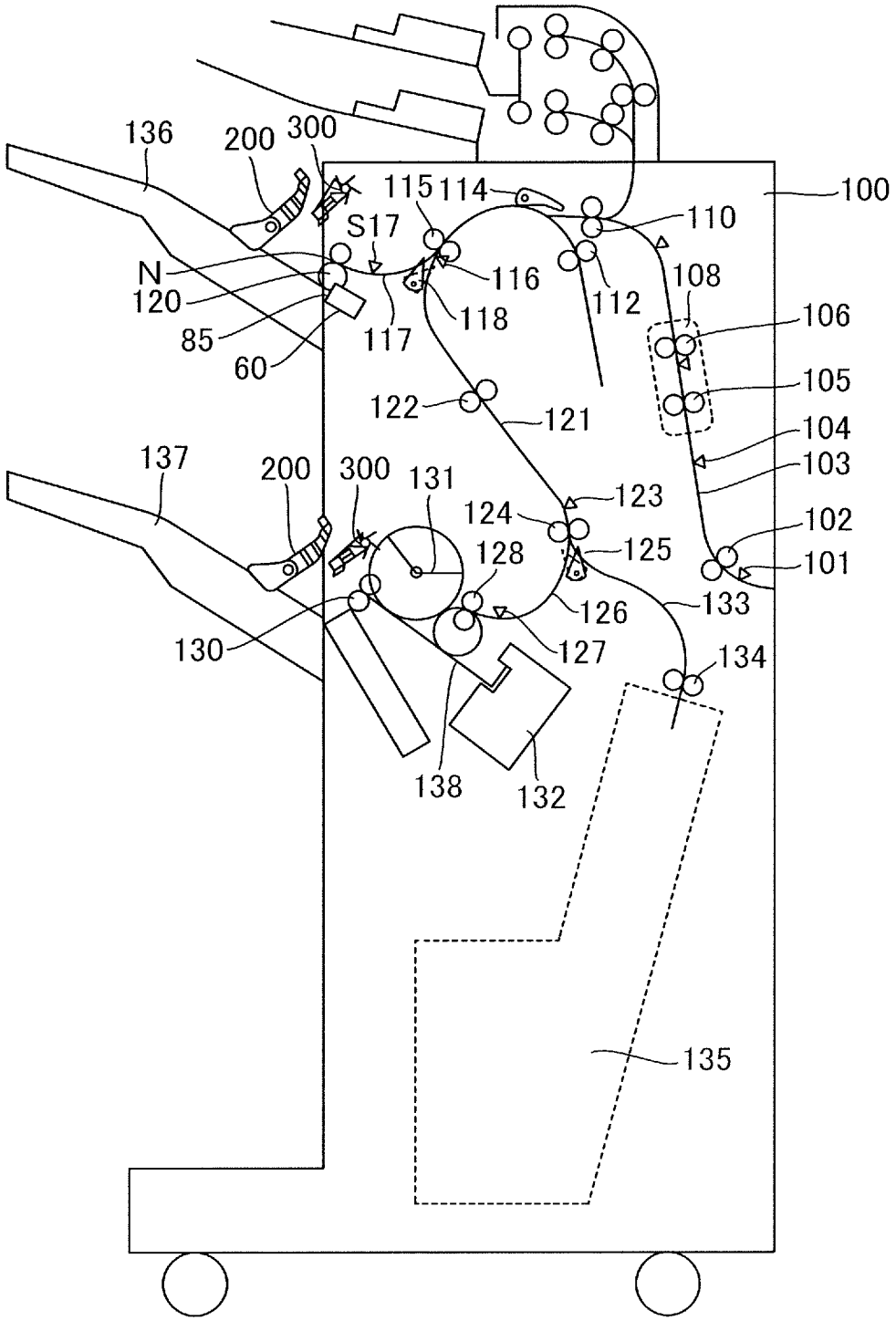
FIG. 2 is a schematic diagram illustrating a sheet stacking apparatus.

The copier 1000 according to the embodiment will be described with reference to FIGS. 1 and 2. FIG. 1 is a cross sectional view configured to schematically illustrate the copier 1000 according to the embodiment. FIG. 2 is a cross sectional view configured to schematically illustrate a finisher 100 as a sheet stacking apparatus according to the embodiment.

As illustrated in FIG. 1, the copier 1000 is provided with a copier main body 600 forming an image on a sheet S, and the finisher 100 as the sheet stacking apparatus. The finisher 100 according to the embodiment is configured to be detachably stacked on the copier main body 600, and can be used as an option in the copier main body 600 which can be independently used. It is noted that, in the embodiment, the detachable finisher 100 is used in descriptions; however, the image forming apparatus may have a configuration in which the finisher 100 and the copier main body 600 are integrated.

The copier main body 600 is provided with a sheet storage portion 602 in which the sheet S is stored, and arranged at the lower part of the copier main body 600, and a sheet feed portion 603 configured to feed the sheet S stored in the sheet storage portion 602. The copier main body 600 is provided with an image forming portion 604 configured to form an image on the sheet S fed by the sheet feed portion 603, a document feeder 605 which can feed a document, and an image reader 606 configured to read information of the document fed from the document feeder 605. The sheet storage portion 602 includes a plurality of cassettes 909*a* and 909*b* configured to store the sheet S.

Subsequently, a series of processes in which the copier main body 600 forms an image on the sheet S will be described. First, the copier main body 600 feeds the sheet S stored in the cassettes 909*a* and 909*b* to the image forming portion 604 at a predetermined timing by the sheet feed portion 603. The image forming portion 604 includes photoconductive drums 914*a* to 914*d* on which toner images of each color of yellow, magenta, cyan, and black are formed, and transfers the toner images of each color formed on the photoconductive drums 914*a* to 914*d* to the sheet S. In this manner, an unfixed toner images are formed on the sheet S. The copier main body 600 forms images on the sheet S by fixing the unfixed toner images to the sheet S by a fixing unit 904. It is noted that, in a case in which information of a document is formed on the sheet S as image information, the copier main body 600 forms toner images corresponding to the image information of the document fed from the document feeder 605, and is read by the image reader 606 on the photoconductive drums 914*a* to 914*d*, and transfers the toner images to the sheet S.

In a case of duplex printing, the copier main body 600 conveys the sheet S by conveyance rollers 906*a* to 906*f* provided in a reverse conveying path to the image forming portion 604 again, after reversing the sheet S by a reverse roller 905, and executes the above described series of processes related to image formation. After executing the series of processes, the copier main body 600 discharges the sheet S to the finisher 100 by a discharging roller 907.

The finisher 100 is connected to the copier main body 600 on the downstream side thereof, introduces a plurality of sheets S conveyed from the copier main body 600, and can perform stapling, saddling, or the like, in line.

As illustrated in FIG. 2, in the finisher 100, the sheet S conveyed from the copier main body 600 is handed to pair of inlet rollers 102. At this time, in the finisher 100, a transfer timing of the sheet S is simultaneously detected by an inlet port sensor 101. The finisher 100 conveys the sheet S by the pair of inlet rollers 102, and detects an end position of the sheet S in the width direction by a lateral registration detection sensor 104 while causing the sheet S to pass through a conveyance path 103. Here, the lateral registration detection sensor 104 is a sensor configured to detect how big is a lateral registration error X of the sheet S at a center position in the width direction.

When the lateral registration detection sensor 104 detects the lateral registration error X, the finisher 100 causes a shifting unit 108 to perform a shifting operation of the sheet S in which the sheet S is moved in the front-back direction (width direction) in the middle of conveying the sheet S by pair of shifting rollers 105 and 106. The shifting operation of the sheet S by the shifting unit 108 is also referred to as a lateral registration detecting process. When the shifting operation of the sheet S by the shifting unit 108 is finished, the finisher 100 conveys the sheet S by conveyance roller pair 110 and pair of buffer rollers 115.

Here, in a case in which the sheet S is discharged to an upper stacking tray 136, the finisher 100 moves an upper path switching member 118 to a position of a dashed line illustrated in FIG. 2 by a drive unit such as a solenoid (not illustrated). In this manner, the finisher 100 guides the sheet S to an upper path discharging path 117, and discharges the sheet to the upper stacking tray 136 by an upper sheet discharge roller pair 120 which conveys the sheet by nipping the sheet in a nip portion N. An upper sheet discharge roller pair 120 configured to discharge the sheet S to the upper stacking tray 136 as a stacking portion configures a discharging portion configured to discharge the sheet after conveying the sheet by nipping thereof. The upper path discharging path 117 which the sheet S being discharged by the upper sheet discharge roller pair 120 passes through configures a discharging path.

The sheet S discharged to the upper stacking tray 136 is subjected to aligning the sheet S on the upper stacking tray 136 in the width direction and the sheet discharging direction by a width direction alignment unit 200, a tray puddle 300 and an abutment member 85 as sheet discharging direction alignment unit. Here, in a case of aligning the sheet S in the width direction, the finisher 100 drives the width direction alignment unit 200, and aligns the sheet S by moving the sheet in the width direction by pressing a side face of the stacked sheet S. In a case of aligning the sheet S in the sheet discharging direction, the finisher 100 performs aligning of the sheet S in the sheet discharging direction by moving the tray puddle 300 onto the upper stacking tray 136, moving the stacked sheet S to the upstream side in the sheet discharging direction, and causing the sheet to come into contact with the abutment member 85. It is noted that, in the following descriptions, in the width direction of the sheet S aligned by width direction alignment unit 200, one direction side will be denoted by near or a near side, and the other direction side will be denoted by back or a far side.

Meanwhile, in a case in which the sheet S is not discharged to the upper stacking tray 136, the finisher 100 moves the upper path switching member 118 to a position of a solid line illustrated in FIG. 2. In this manner, the finisher 100 guides the sheet S to a bundle conveyance path 121, and causes the sheet to pass the inside of the bundle conveyance path 121 by a pair of buffer rollers 122 and bundle conveyance roller pair 124.

In a case in which the sheet S is subjected to a saddle stitch process (saddling process), the finisher 100 guides the sheet S to a saddle path 133 by moving a saddle path switching member 125 to a position of a dashed line illustrated in FIG. 2 by a drive unit such as a solenoid (not illustrated). The finisher 100 conveys the sheet S to a saddle unit 135 by a pair of saddle inlet rollers 134, and performs the saddle stitch process (saddling process).

Meanwhile, in a case in which the saddle stitch process (saddling process) is not performed, the finisher 100 moves the saddle path switching member 125 to the position of the solid line illustrated in FIG. 2, and conveys the sheet S by the bundle conveyance roller pair 124. In a case of performing a binding process, the finisher 100 sequentially conveys the sheet S onto a processing tray 138 of a stapling unit 127, and performs a binding process using a stapler 132 after performing aligning of the sheet S in the sheet discharging direction and the width direction. Thereafter, the finisher 100 discharges the sheet S to a lower stacking tray 137 by bundle discharge roller pair 130. Meanwhile, in a case in which a binding process is not performed in the stapling unit 127, the finisher 100 causes the sheet S to be delivered from a lower sheet discharge roller pair 128 to the bundle discharge roller pair 130 without passing the processing tray 138, and discharges the sheet to the lower stacking tray 137. The sheet S discharged to the lower stacking tray 137 is subjected to aligning the sheet S on the lower stacking tray 137 in the width direction and the sheet discharging direction by the width direction alignment unit 200 and the abutment member 85 as the discharging direction alignment unit, similarly to the sheet S discharged to the upper stacking tray 136.

Figure 3:
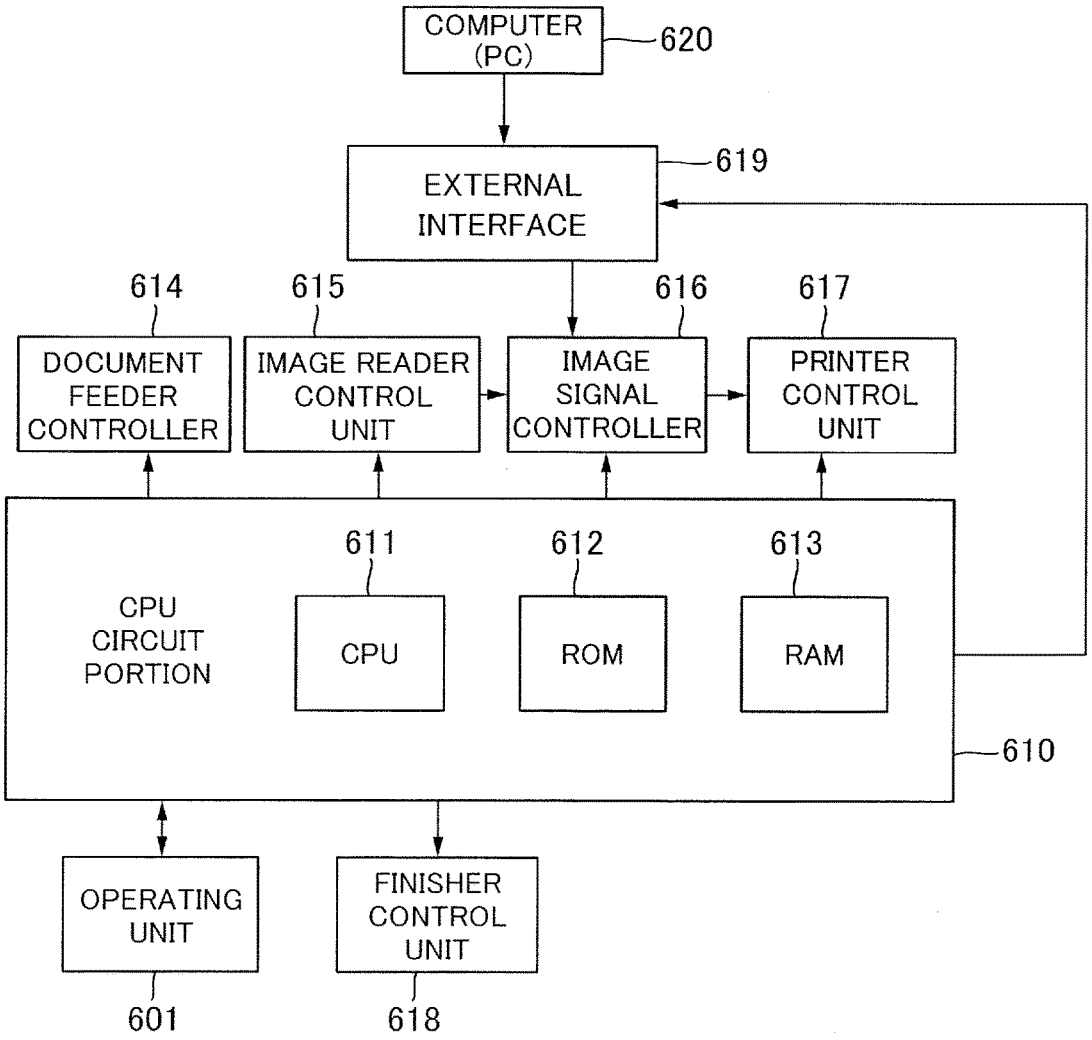
FIG. 3 is a block diagram illustrating a configuration of a control portion of the image forming apparatus.
Figure 4:
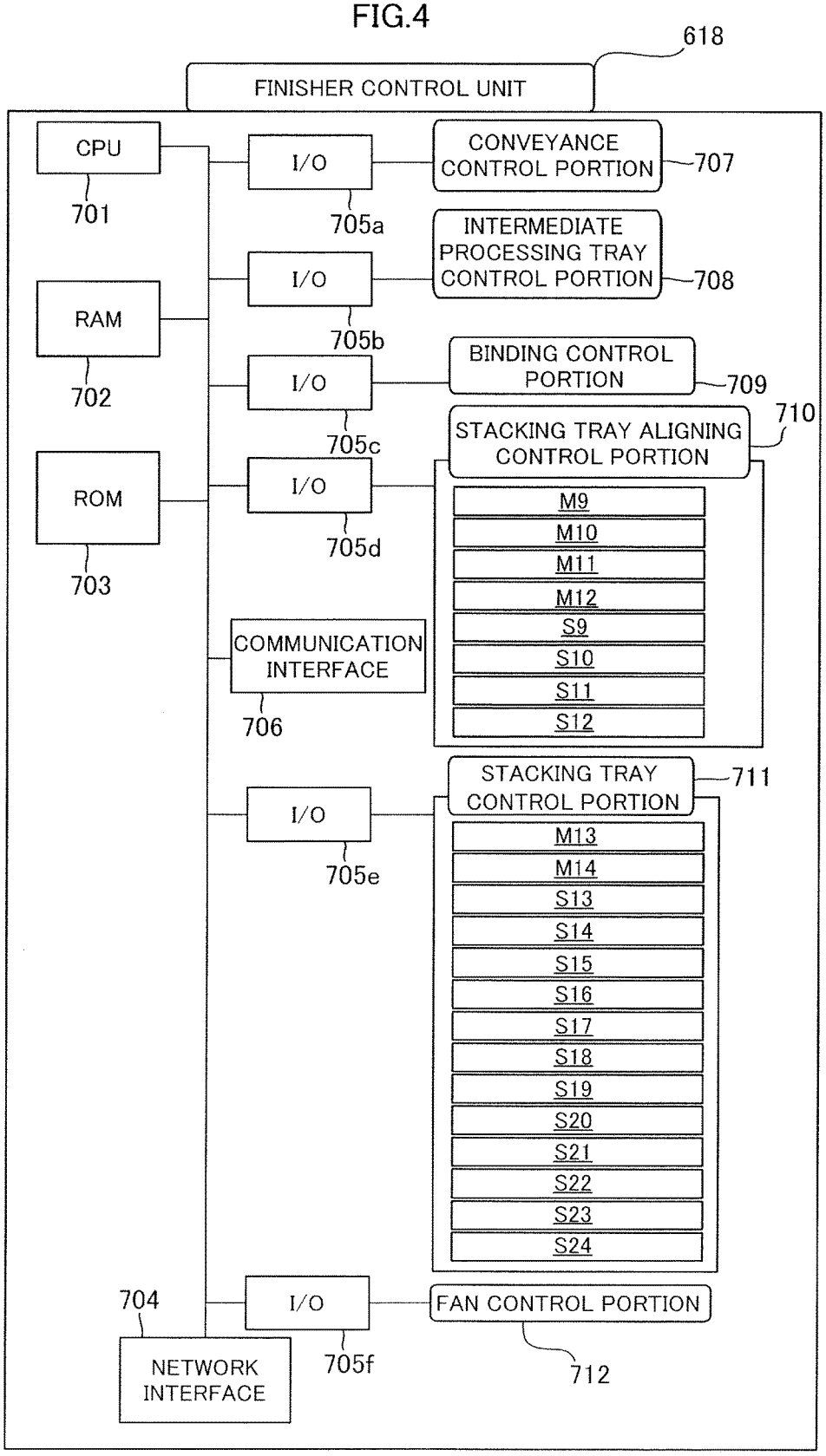
FIG. 4 is a block diagram illustrating a configuration of a finisher control unit.

Subsequently, a CPU circuit portion 610 which controls the copier 1000 according to the embodiment will be described with reference to FIGS. 3 and 4. FIG. 3 is a block diagram of the CPU circuit portion 610 which controls the copier 1000 according to the embodiment. FIG. 4 is a block diagram of a finisher control unit 618 according to the embodiment.

As illustrated in FIG. 3, the CPU circuit portion 610 is provided with a CPU 611 which controls each element electrically connected to the CPU circuit portion 610 according to a program contained in a ROM 612, and instruction information input from an operating unit 601. The CPU circuit portion 610 is provided with a RAM 613 used as an area in which control data is temporarily held, or a work area of an arithmetic calculation which is associated with a control.

A document feeder controller 614 which controls the document feeder 605, and an image reader control unit 615 which controls the image reader 606 are electrically connected to the CPU circuit portion 610. An image signal controller 616 which converts information of a document read by the image reader 606 into image information which can form an image, and a printer control unit 617 which controls the copier main body 600 are electrically connected to the CPU circuit portion 610. Here, the image signal controller 616 can output print data to the printer control unit 617 by converting the print data into data which can form an image, even in a case in which the print data input from an external computer 620 which is electrically connected through an external interface 619 is output.

The operating unit 601 which receives an operation from a user is also electrically connected to the CPU circuit portion 610. The CPU circuit portion 610 stores sheet information which is input to the RAM 613, in a case in which sheet information such as a grammage, a coated sheet/non-coated sheet, a length of the sheet in the direction of conveyance, and a length of the sheet in the width direction orthogonal to the direction of conveyance is input from the operating unit 601 by a user. It is noted that, the sheet information can also be input from the external computer 620. The finisher control unit 618 which controls the finisher 100 is electrically connected to the CPU circuit portion 610.

As illustrated in FIG. 4, the finisher control unit 618 is provided with a CPU (microcomputer) 701, a RAM 702, a ROM 703, input-output units (I/O) 705*a* to 705*f*, a communication interface 706, and a network interface 704.

The finisher control unit 618 is provided with a conveyance control portion 707 which performs each control process such as the above described lateral registration detecting process of the sheet S, a buffering process in which the sheet S is buffered, and a conveyance process in which the sheet S is conveyed in the finisher 100. The finisher control unit 618 is provided with an intermediate processing tray control portion 708 which performs an aligning process of the sheet S in the sheet discharging direction and the width direction in order to perform a binding process with respect to the sheet S on the processing tray 138. The finisher control unit 618 is provided with a binding control portion 709 which performs a binging process with respect to the sheet S on the processing tray 138.

The finisher control unit 618 is provided with a stacking tray aligning control portion 710 which has various motors or sensors which drive and control the width direction alignment unit 200 or the tray puddle 300 which aligns the sheet S stacked on the upper stacking tray 136 or the lower stacking tray 137.

A detail of the stacking tray aligning control portion 710 will be described. The stacking tray aligning control portion 710 is provided with a front alignment unit slide motor M9 which drives the width direction alignment unit 200 so that the sheet S is moved from one side (near side) to the other side (far side) when performing aligning of the sheet S in the width direction by the width direction alignment unit 200.

The stacking tray aligning control portion 710 is provided with a back alignment unit slide motor M10 which drives the width direction alignment unit 200 so that the sheet S is moved from the other side (far side) to the one side (near side) when performing aligning of the sheet S in the width direction by the width direction alignment unit 200. The stacking tray aligning control portion 710 is provided with a width direction alignment unit elevating motor M11 which drives the width direction alignment unit 200 so as to be lifted, in order to position the width direction alignment unit 200 at an appropriate position in the thickness direction (vertical direction) of the sheet S.

The stacking tray aligning control portion 710 is provided with a front alignment unit HP sensor S9, a back alignment unit HP sensor S10, and a width direction alignment unit elevating HP sensor S11 which detects each home position as a reference of a position when driving the width direction alignment unit 200 in the width direction or the vertical direction. The stacking tray aligning control portion 710 performs aligning in the width direction of the sheet S stacked on the upper stacking tray 136 or the lower stacking tray 137 by driving the width direction alignment unit 200 using each of the motors and each of the sensors.

The stacking tray aligning control portion 710 is provided with a tray puddle elevating motor M12 which causes the tray puddle 300 to be lifted, and a tray puddle HP sensor S12 which detects a home position as a reference of a vertical position of the tray puddle 300. The stacking tray aligning control portion 710 drives the tray puddle 300 by the tray puddle elevating motor M12 and the tray puddle HP sensor S12, and helps aligning in the sheet discharging direction of the sheet S stacked on the upper stacking tray 136 or the lower stacking tray 137.

The finisher control unit 618 is provided with a stacking tray control portion 711 which includes various motors or sensors which drive and control the upper stacking tray 136 and the lower stacking tray 137 in order to control positions, or the like, of the upper stacking tray 136 and the lower stacking tray 137.

A detail of the stacking tray control portion 711 will be described. The stacking tray control portion 711 is provided with an upper stacking tray elevating motor M13 which moves the upper stacking tray 136 in the vertical direction, and an upper stacking tray position detecting sensor S13 which detects a position of the upper stacking tray 136 in the vertical direction. The stacking tray control portion 711 is provided with a sheet presence detection sensor S15 in the upper stacking tray which detects whether or not the sheet S is stacked on the upper stacking tray 136. The stacking tray control portion 711 drives the upper stacking tray elevating motor M13 using information of the upper stacking tray position detecting sensor S13 and the sheet presence detection sensor S15 in the upper stacking tray, and sets a position of the upper stacking tray 136 to an appropriate position.

The stacking tray control portion 711 is provided with an upper path detection sensor S17 as a sheet detection portion which detects a position of the sheet S in the upper path discharging path 117, in a case in which the sheet S is discharged to the upper stacking tray 136. Here, the upper path detection sensor S17 is a sensor configured to enter an ON state when a leading end of the sheet S passes through the upper path detection sensor S17, and enter an OFF state when a trailing end of the sheet S passes through the upper path detection sensor S17. When the upper path detection sensor S17 enters an ON state, the stacking tray control portion 711 is configured so as to perform an arithmetic operation based on a discharging speed of the sheet S, and calculate a position of the sheet S in the upper path discharging path 117.

The stacking tray control portion 711 is provided with an upper first detection sensor S19 which detects an abnormality when a discharged sheet S leans against the upper sheet discharge roller pair 120, or the like, and an upper second detection sensor S20 which detects a top face of the sheets S stacked on the upper stacking tray 136. The stacking tray control portion 711 is provided with an upper third detection sensor S21 which detects that a height of the top face of the sheets S stacked on the upper stacking tray 136 becomes suddenly low, when a user removes the sheet S stacked on the upper stacking tray 136, or the like.

It is noted that the stacking tray control portion 711 has the same configuration as that of the upper stacking tray 136, as a configuration of controlling a position of the lower stacking tray 137. That is, the stacking tray control portion 711 is provided with a lower stacking tray elevating motor M14, a lower stacking tray position detecting sensor S14, a sheet presence detection sensor S16 in the lower stacking tray, a lower path detection sensor S18, and lower first to third detection sensors S22 to S24.

The finisher control unit 618 is provided with a fan control portion 712 as an air volume control portion which controls an air volume of an upper discharging fan 60, which will be described later.

Subsequently, in the finisher 100 according to the embodiment, an operation of discharging the sheet S in a non-bound state in which a saddle stitch process and a binding process are not performed with respect to the upper stacking tray 136 will be described by using FIGS. 5 to 12.

Figure 5:
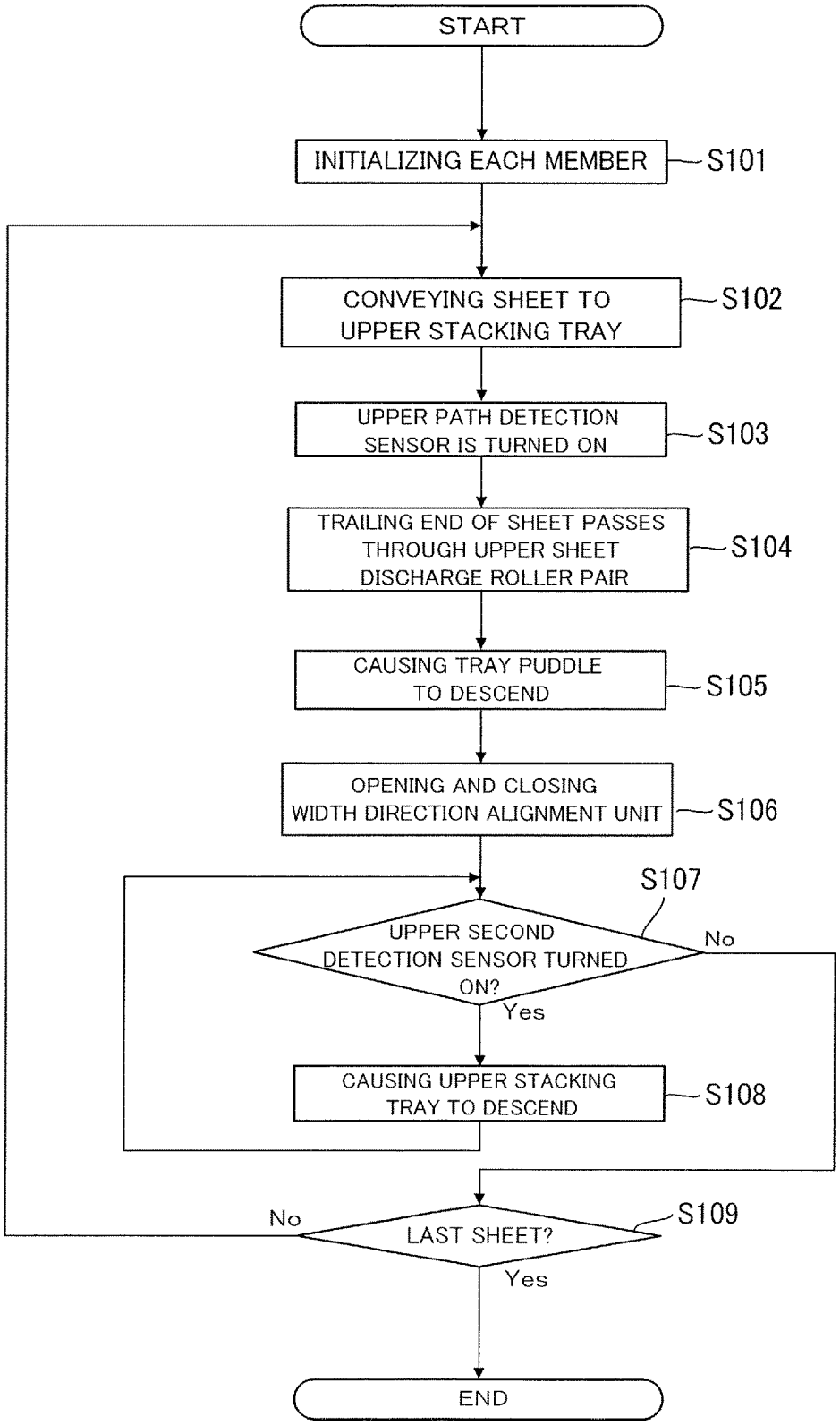
FIG. 5 is a flowchart illustrating a control process performed by the finisher control unit.

FIG. 5 is a flowchart configured to illustrate each control process performed by a configuration other than the fan control portion 712 in the finisher control unit 618, in a case in which the sheet S is discharged to the upper stacking tray 136, in the finisher 100 according to the embodiment.

First, the finisher control unit 618 performs initialization of each member which configures the finisher 100, along with inputting of a job of discharging the sheet S (step S101). Subsequently, the conveyance control portion 707 in the finisher control unit 618 drives each of conveyance roller pair such as the pair of inlet rollers 102, or a pair of shifting rollers 105 and 106 in order to convey the sheet S to the upper stacking tray 136. It is noted that, the conveyance control portion 707 drives the upper path switching member 118, and causes the sheet S to be conveyed to the upper stacking tray 136 by passing through the upper path discharging path 117 (step S102). In the finisher control unit 618, the upper path detection sensor S17 is turned on when the sheet S is conveyed to the upper path discharging path 117 (step S103).

Subsequently, a trailing end of the sheet S passes through the nip portion N of the upper sheet discharge roller pair 120 when the conveyance control portion 707 drives the upper sheet discharge roller pair 120, and the sheet S is discharged to the upper stacking tray 136 (step S104). Here, the finisher control unit 618 calculates a timing in which the trailing end of the sheet S passes through the nip portion N of the upper sheet discharge roller pair 120 based on a discharging speed of the sheet S discharged by the upper sheet discharge roller pair 120, and a length of the sheet S in the sheet discharging direction.

Figure 6A:
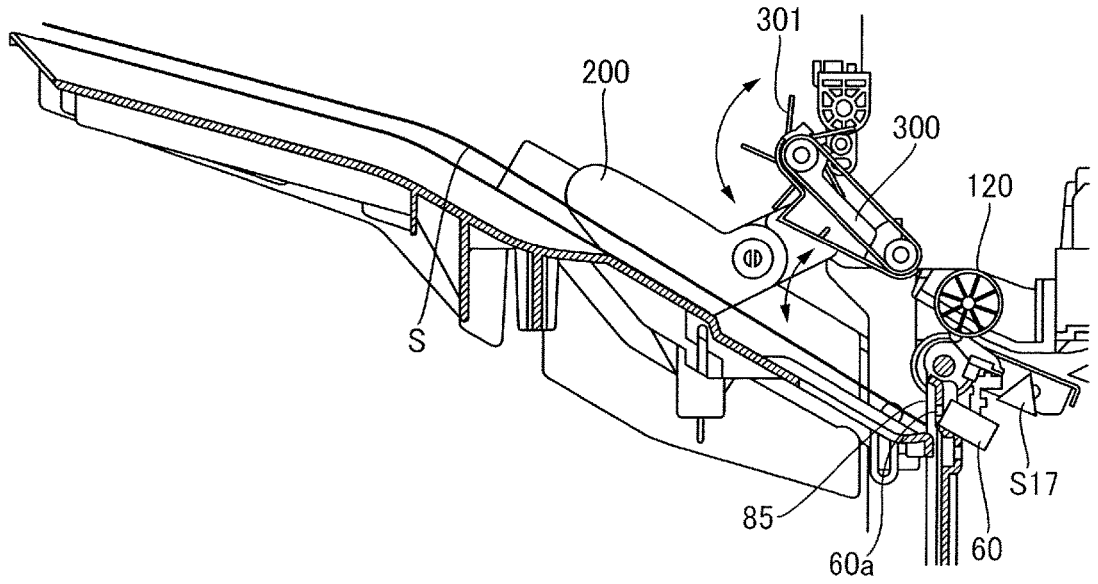
FIG. 6A is a front view illustrating a configuration of aligning a sheet stacked on a stacking tray.

Subsequently, the stacking tray aligning control portion 710 of the finisher control unit 618 drives the tray puddle elevating motor M12, and causes the tray puddle 300 to descend (step S105). As illustrated in FIG. 6A, a puddle 301 which rotates counterclockwise in synchronism with the upper sheet discharge roller pair 120 is provided at a leading end of the tray puddle 300. In a case in which the tray puddle 300 is descended, the puddle 301 comes into contact with the top face of the sheets S stacked on the upper stacking tray 136, on the upper stacking tray 136. On the upper stacking tray 136, the sheet S is urged to the upstream side in the sheet discharging direction by the puddle 301, and the sheet S comes into contact with the abutment member 85 arranged on the upstream side of the upper stacking tray 136 in the sheet discharging direction. In this manner, the finisher 100 can perform aligning of the sheet S stacked on the upper stacking tray 136 in the sheet discharging direction.

Subsequently, the stacking tray aligning control portion 710 drives the front alignment unit slide motor M9, the back alignment unit slide motor M10, and the width direction alignment unit elevating motor M11, in order to perform aligning of the sheet S in the width direction by the width direction alignment unit 200 (step S106). By driving each motor, and driving the width direction alignment unit 200, the stacked sheet S comes into contact with the width direction alignment unit 200 in the width direction, on the upper stacking tray 136, and aligning of the sheet in the width direction is performed when an end portion of the sheet S is aligned.

Figure 6B:
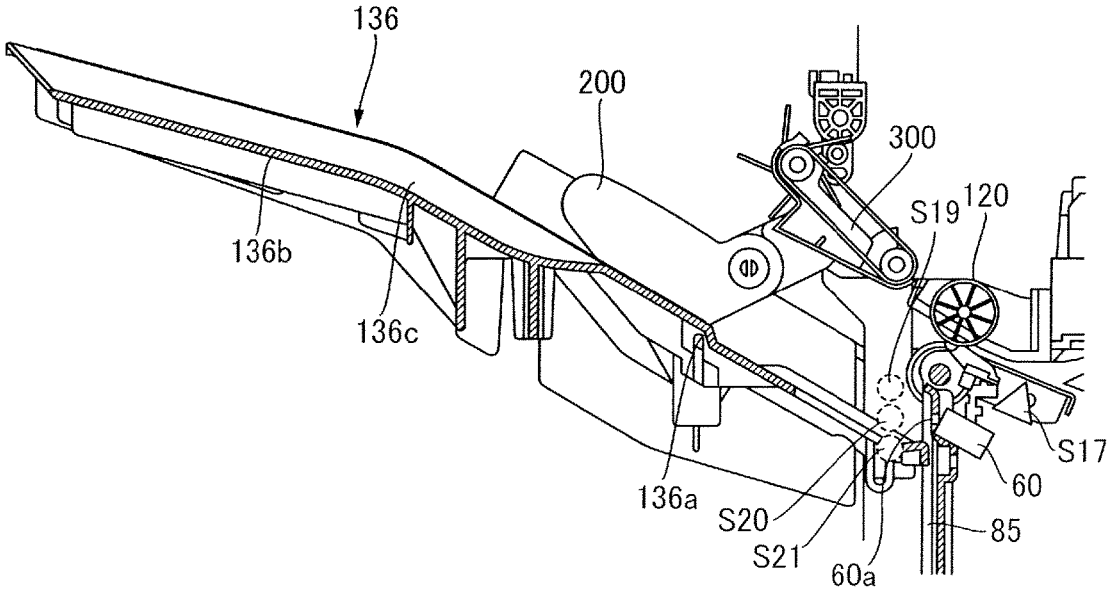
FIG. 6B is a front view illustrating a position of a sensor arranged in the stacking tray.

Subsequently, the stacking tray control portion 711 of the finisher control unit 618 determines whether or not the upper second detection sensor S20 in turned on (step S107). In the process, in a case in which it is determined that the upper second detection sensor S20 in turned on (Yes), the stacking tray control portion 711 drives the upper stacking tray elevating motor M13, and causes the upper stacking tray 136 to descend (step S108). The stacking tray control portion 711 repeats processes in steps S107 and S108 until the upper second detection sensor S20 is turned off (No in step S107). It is noted that, as illustrated in FIG. 6B, the upper first to third detection sensors S19 to S21 are arranged on the upstream side of the sheet S in the sheet discharging direction in the upper stacking tray 136. All of sensors are configured of optical sensors which enter an ON state by entering a light-shielding state, and enter an OFF state in a light-transmitting state.

In a case in which the upper second detection sensor S20 enters an OFF state (No in step S107), the stacking tray control portion 711 determines whether the sheet S which passes through the upper sheet discharge roller pair 120 in step S104 is the last sheet in the input job (step S109). In a case of determining that the sheet is not the last sheet (No in step S109), the finisher control unit 618 returns the process to step S102. In a case of determining that the sheet is the last sheet (Yes in step S109), the finisher control unit 618 finishes the process.

Figure 7:
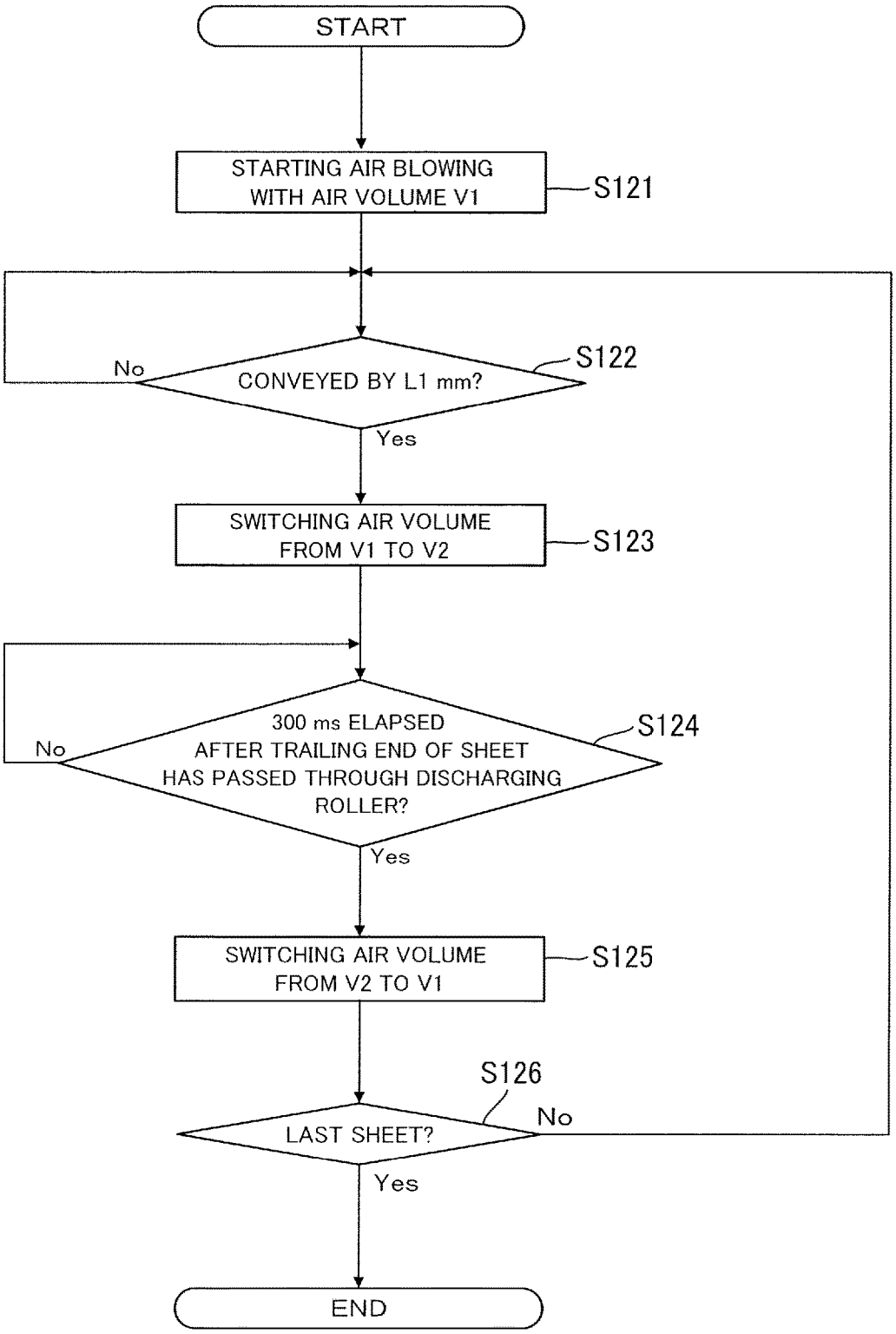
FIG. 7 is a flowchart illustrating a control process performed by a fan control portion.

Subsequently, the above described control process performed by the fan control portion 712 in a case in which the sheet S in a non-bound state is discharged to the upper stacking tray 136, and the sheet S is stacked on the upper stacking tray 136 will be described. FIG. 7 is a flowchart configured to illustrate each control process performed by the fan control portion 712 in the finisher control unit 618, in a case in which the sheet S is discharged to the upper stacking tray 136, in the finisher 100 according to the embodiment.

Figure 8A:
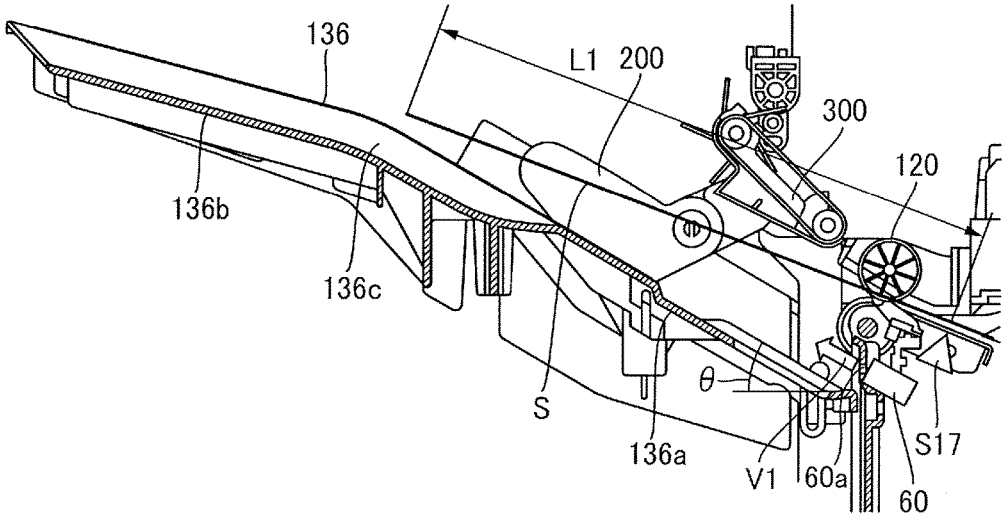
FIG. 8A is a front view illustrating a state in which the sheet is discharged with a first air volume in the stacking tray.

First, the fan control portion 712 causes the upper discharging fan 60 to start air blowing with a first air volume V1 which is relatively large, when a job of discharging the sheet S is input (step S121). That is, the fan control portion 712 controls the upper discharging fan 60 so as to rotate at a rotational speed which becomes the first air volume V1 (first rotational speed). According to the embodiment, as illustrated in FIG. 8A, the upper discharging fan 60 is provided in the vicinity of the lower part of the upper sheet discharge roller pair 120, and wind is discharged from a vent 60*a* arranged in the upper path discharging path 117, and on the lower part of the nip portion N of the upper sheet discharge roller pair 120. The upper discharging fan 60 rotatably drives a vane wheel which generates wind by rotating, blows air toward a direction in which the sheet S is discharged, and causes the wind to hit a lower face of the sheet S. That is, the upper discharging fan 60 blows the air so that wind flows along a lower face of the sheet in the middle of being conveyed by the upper sheet discharge roller pair 120, and atop face of an uppermost sheet stacked on the upper stacking tray 136. In this manner, the upper discharging fan 60 which blows the air toward a direction in which the sheet S is discharged, and the vent 60*a* configure an air blowing unit according to the embodiment. It is noted that an air volume according to the embodiment means a volume of air per unit area in the vent 60*a*, and per unit hour. Buoyance which acts with respect to the upper sheet discharge roller pair 120 due to wind generated by the upper discharging fan 60 may be defined as an air volume.

Subsequently, the fan control portion 712 determines whether or not the sheet S is conveyed by L1 mm after a leading end of the sheet S is detected by the upper path detection sensor S17 of the stacking tray control portion 711 in the above described process in step S103 (step S122). Subsequently, the fan control portion 712 switches a volume of air blown by the upper discharging fan 60 from the first air volume V1 to a second air volume V2 which is relatively small (step S123). That is, the fan control portion 712 controls the upper discharging fan 60 so that the upper discharging fan 60 rotates in a rotational speed which becomes a second air volume V2 (second rotational speed), and is lower than a rotational speed which becomes the first air volume V1. Subsequently, the fan control portion 712 determines whether or not 300 millisecond (hereinafter referred as "ms") has elapsed after the trailing end of the sheet S passed through the nip portion N of the upper sheet discharge roller pair 120 (step S124), and in a case in which 300 ms has not elapsed (No in step S124), the fan control portion repeats the process in step S124 until 300 ms elapses. In a case in which it is determined that 300 ms elapsed after the trailing end of the sheet S passed through the nip portion N (Yes in step S124), the fan control portion 712 switches the volume of air blown by the upper discharging fan 60 from the second air volume V2 to the first air volume V1 (step S125).

A detail of a control process performed by the fan control portion 712 in steps S121 to S125 will be described. According to the embodiment, the upper stacking tray 136 includes a first surface 136*a* provided on the upstream side in the sheet discharging direction, and is a relatively steep slope with respect to the sheet discharging direction of the sheet S. The upper stacking tray 136 includes a second surface 136*b* which is an easy slope with respect to the first face, and is provided on the downstream side in the sheet discharging direction, and a connection portion 136*c* as a connecting place between the first surface 136*a* and the second surface 136*b*. The first surface 136*a* is inclined so as to have an angle θ with respect to a horizontal plane. For this reason, on the upper stacking tray 136, the sheet S stacked on the first surface 136*a* can move to the upstream side in the sheet discharging direction due to its own weight.

Figure 8B:
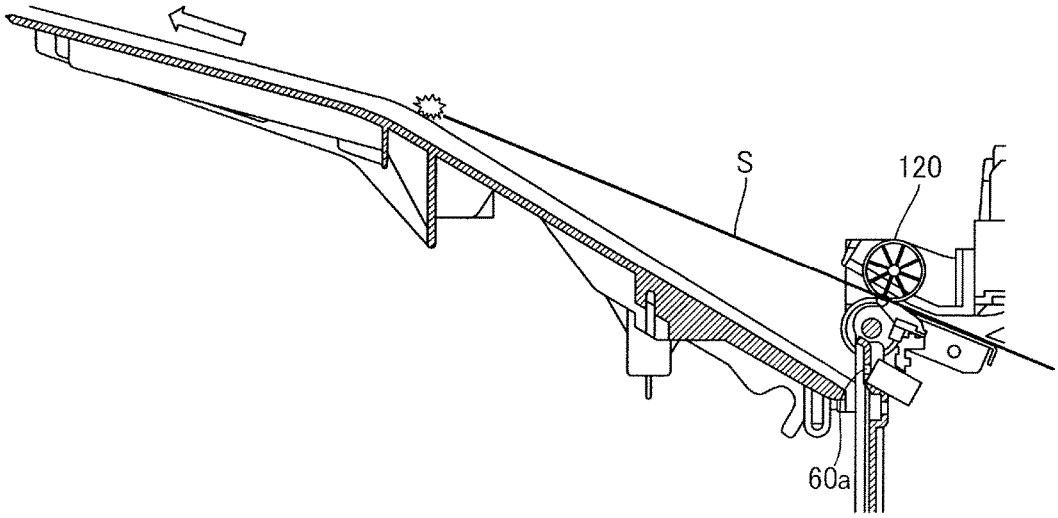
FIG. 8B is a front view illustrating a state in which the sheet is discharged without air blowing in the stacking tray.

As illustrated in FIG. 8A, a position of the connection portion 136*c* in the upper stacking tray 136 is set to a position separated from the upper path detection sensor S17 by approximately L1 mm. That is, a distance L1 corresponds to a length in which a leading end of the sheet S discharged from the upper sheet discharge roller pair 120 comes into contact with the upper stacking tray 136, if there is no air blowing from the upper discharging fan 60. As illustrated in FIG. 8B, in a case of assuming that there is no air blowing by the upper discharging fan 60, a leading end of a discharged sheet comes into contact with a stacked sheet on the upper stacking tray 136 when the leading end of the sheet S reaches the vicinity of the connection portion 136*c*, and pushing-out of the stacked sheet by the discharge sheet can occur. For this reason, according to the embodiment, it is possible to prevent the stacked sheet from being pushed out by being in contact with the leading end of the sheet S, by causing the upper discharging fan 60 to blow the air with the first air volume V1 while the sheet S is discharged to the position of the connection portion 136*c* from the upper path detection sensor S17. That is, the first air volume V1 is an air volume which can prevent the stacked sheet from being pushed out due to a leading end of a discharge sheet.

In the process in step S122, the fan control portion 712 determines whether or not the sheet S is conveyed by L1 mm, by determining whether or not a discharging time Ta has elapsed after the leading end of the sheet S passed through the upper path detection sensor S17. Here, the discharging time Ta is a time set based on a discharging speed of the sheet S. For this reason, a value of the discharging time Ta taken between detecting the leading end of the sheet S by the upper path detection sensor S17 and determining that the sheet S is conveyed by L1 mm is set to a small value in a case of a high discharging speed, and is set to a large value in a case of a low discharging speed.

Figure 9:
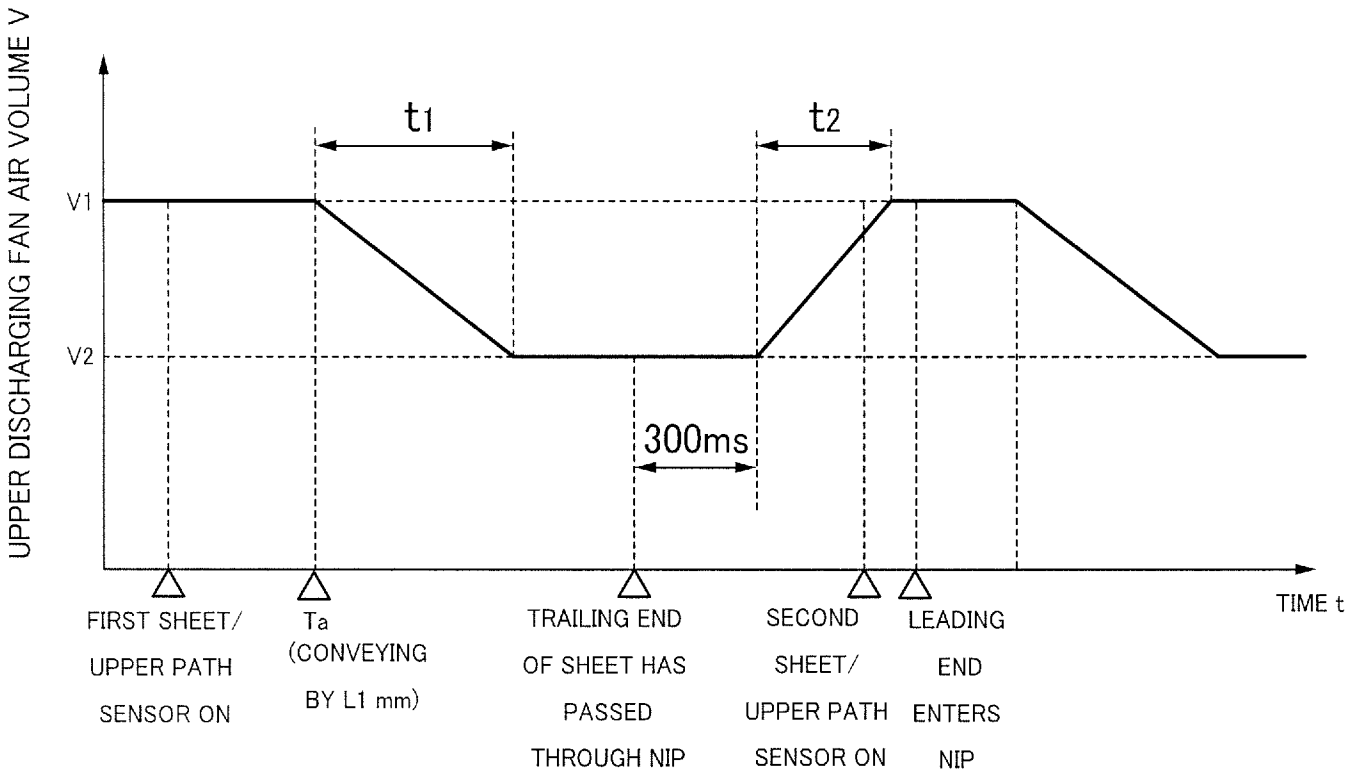
FIG. 9 is a graph illustrating a relationship between control of an air volume and time performed by the fan control portion according to the embodiment of this disclosure.

FIG. 9 illustrates a relationship between a passage of time and a change in the volume of the air blown by the upper discharging fan 60 in processes in steps S121 to S125. In the upper discharging fan 60 according to the embodiment, a first response time t1 is necessary when an air volume is changed from V1 to V2, and a second response time t2 is necessary when the air volume is changed from V2 to V1. That is, the upper discharging fan 60 has low responsivity, similarly to a general fan.

As illustrated in FIG. 9, the fan control portion 712 performs the process in step S123 at a point of time in which the leading end of the sheet S is conveyed by L1 mm. Here, it is necessary for the fan control portion 712 to prevent the trailing end of the sheet S from passing through the nip portion N of the upper sheet discharge roller pair 120 before elapsing of the first response time t1 which is necessary when switching the air volume from the first air volume V1 to the second air volume V2.

For that reason, the fan control portion 712 starts switching of the volume of air blown by the upper discharging fan 60 from the first air volume V1 to the second air volume V2, from a point of time in which the discharging time Ta in which the leading end of the sheet S is conveyed by L1 mm elapsed. In this manner, the fan control portion 712 can finish switching of the volume of air blown by the upper discharging fan 60 from the first air volume V1 to the second air volume V2 before the trailing end of the sheet S passes through the nip portion N. In this manner, the fan control portion 712 determines a timing of starting a control of switching the first air volume V1 and the second air volume V2 therebetween, using the first response time t1 necessary for the upper discharging fan 60 when switching from the first air volume V1 to the second air volume V2, and a discharging speed of the sheet S.

Figure 10:
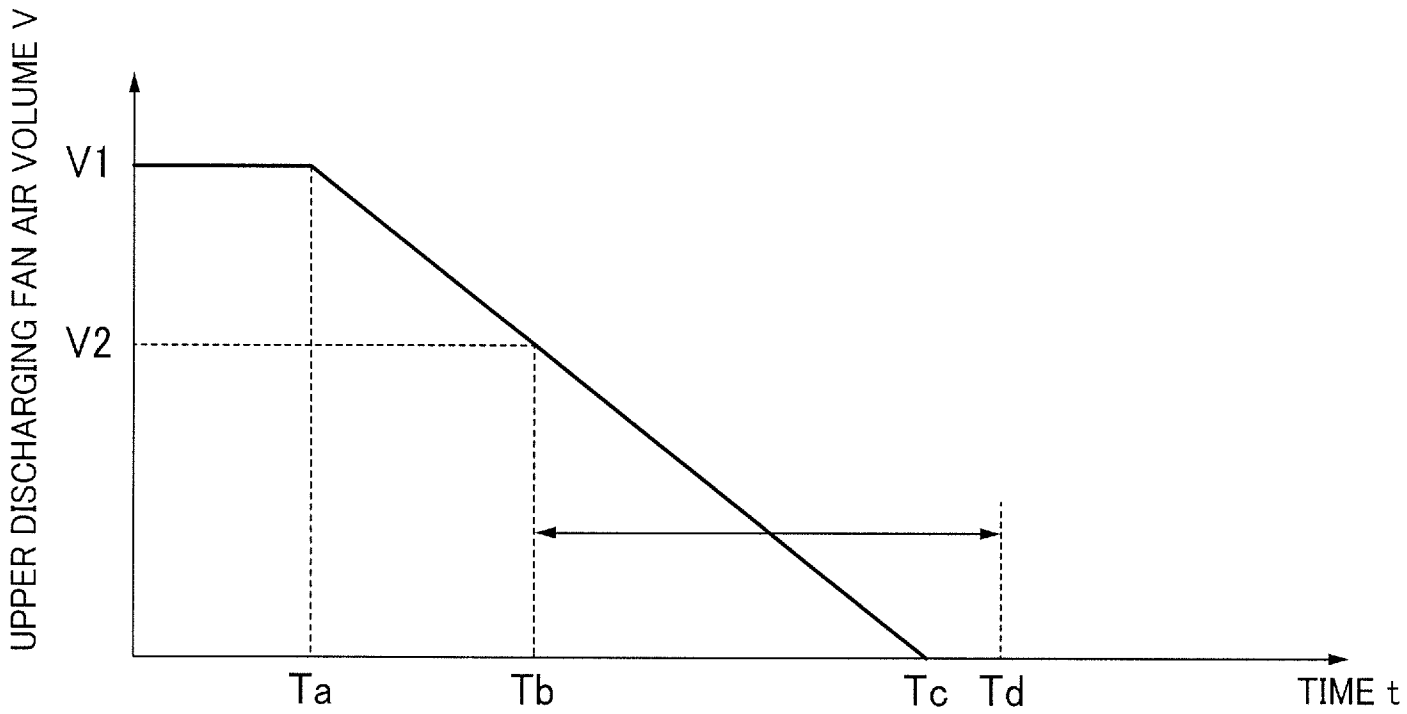
FIG. 10 is a graph illustrating a relationship between control of an air volume and time in a case in which the fan control portion stops air blowing after blowing the air with the first air volume.
Figure 11A:
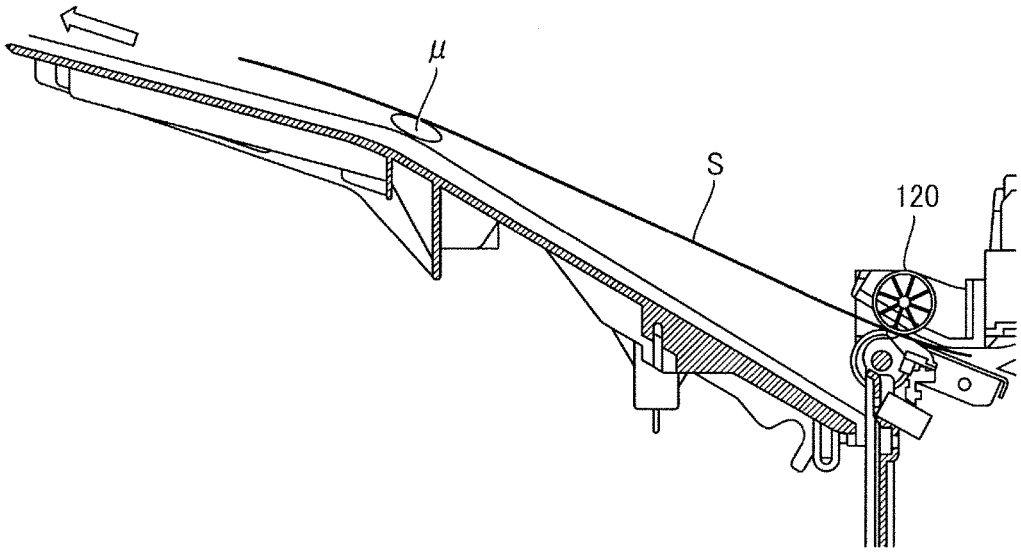
FIG. 11A is a front view illustrating a state in which the sheet is discharged without air blowing in the stacking tray.

Here, in a case of assuming that a control is performed so that an air volume is changed from the first air volume V1 to zero, that is, the air volume is stopped, after the sheet S is conveyed by L1 mm, a volume of air blown by the upper discharging fan 60 is changed as illustrated in a graph in FIG. 10. As illustrated in FIG. 10, due to a decrease in air volume, air blowing by the upper discharging fan 60 is performed with the second air volume V2 or less between a time Tb having the second air volume V2 and a time Tc having an air volume of zero. Air blowing by the upper discharging fan 60 is stopped between the time Tc and a time Td in which the trailing end of the sheet S passes through the nip portion N of the upper sheet discharge roller pair 120. For this reason, as illustrated in FIG. 11A, the lower face of the discharge sheet and the top face of the stacked sheet are subjected to a friction contact on the upper stacking tray 136 between the time Tb and the time Td. The stacked sheet is pushed out to the downstream side in the sheet discharging direction due to friction μ between the lower face of the discharge sheet and the top face of the stacked sheet.

Figure 11B:
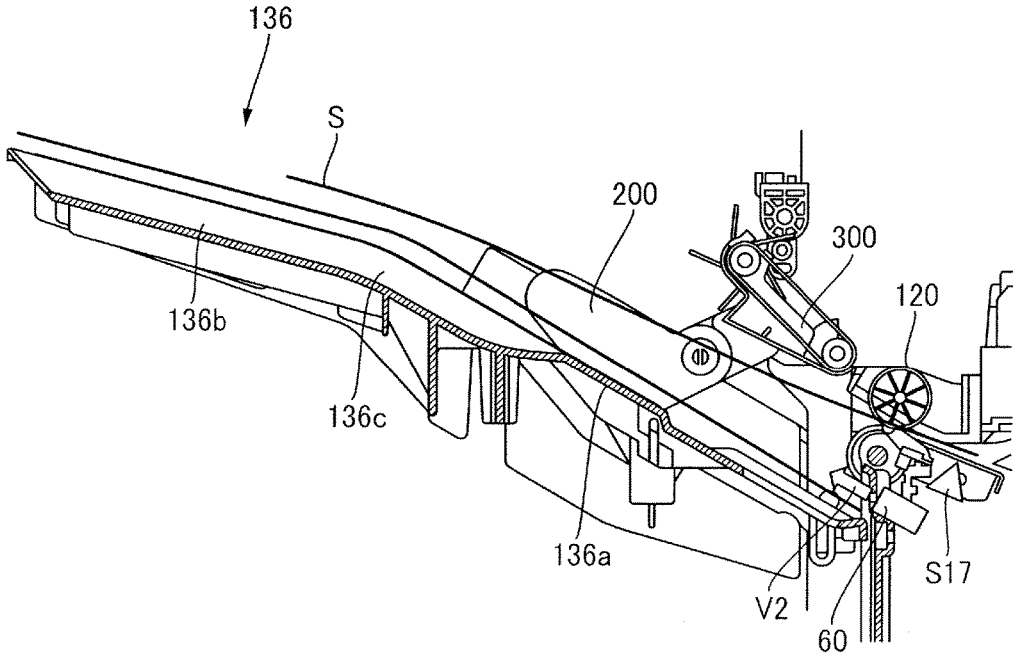
FIG. 11B is a front view illustrating a state in which the sheet is discharged with a second air volume in the stacking tray.

According to the embodiment, the fan control portion 712 controls an air volume of the upper discharging fan 60 so as to be switched from the first air volume V1 to the second air volume V2, after the sheet S is conveyed by L1 mm, as described above. After switching to the second air volume V2, the fan control portion 712 causes the upper discharging fan 60 to perform air blowing with the second air volume V2 until 300 ms elapses, after the trailing end of the sheet S passed through the nip portion N of the upper sheet discharge roller pair 120. In this manner, as illustrated in FIG. 11B, the fan control portion 712 can set a so-called air-lubrication state in which a friction force is not generated by interposing air between a lower face of a discharge sheet and a top face of a stacked sheet. In this manner, the fan control portion 712 can prevent a friction contact between the lower face of the discharge sheet and the top face of the stacked sheet, and prevent the stacked sheet from being pushed out to the downstream side in the sheet discharging direction due to friction μ. It is noted that, in a case in which air blowing is performed with the second air volume V2 in a state in which there isn't any stacked sheet, on the upper stacking tray 136, air is interposed between the upper stacking tray 136 and a lower face of a discharge sheet after the discharge sheet is discharged. It is noted that, it is set so that friction μ becomes zero by interposing air between the lower face of the discharge sheet and the top face of the stacked sheet; however, it is not limited to this. That is, the second air volume V2 of the upper discharging fan 60 is an air volume in which a friction force μ between a lower face of the sheet discharged by the upper sheet discharge roller pair 120 and the sheet stacked on the upper stacking tray 136 is smaller than a friction force between the upper most sheet stacked on the upper stacking tray 136 and a sheet which supports the upper most sheet. In a case in which only one sheet is stacked on the upper stacking tray 136, the second air volume V2 is an air volume in which the friction force μ between the lower face of the sheet discharged by the upper sheet discharge roller pair 120 and the sheet stacked on the upper stacking tray 136 is smaller than a friction force between the one sheet stacked on the upper stacking tray 136 and the upper stacking tray 136.

When air blowing is performed with the first air volume V1 in a condition in which the trailing end of the sheet S passes through the nip portion N of the upper sheet discharge roller pair 120, a landing spot of the discharge sheet is largely deviated to the downstream side in the sheet discharging direction, and there also is a possibility that the discharge sheet falls from the upper stacking tray 136. Even in a case of not falling, when aligning in the width direction and the sheet discharging direction is performed by the width direction alignment unit 200 and the tray puddle 300 in the stacking tray 136, the stacked sheet is influenced by wind from the upper discharging fan 60 with the first air volume V1, and a behavior of the leading end of the stacked sheet easily becomes rough. For this reason, in a case in which air blowing is continuously performed with the first air volume V1, without switching to the second air volume V2, a position of a stacked sheet becomes unstable, and there is a lack of stability (stacking performance) at a position of the stacked sheet in the sheet discharging direction and the width direction, on the upper stacking tray 136.

However, as also illustrated in FIG. 9, the fan control portion 712 performs a control so that the air volume from the upper discharging fan 60 is completely switched to the second air volume V2 smaller than the first air volume V1, when the trailing end of the sheet S passes through the nip portion N of the upper sheet discharge roller pair 120. By performing such a control, the finisher 100 prevents a landing spot of a discharge sheet from being largely deviated to the downstream side in the sheet discharging direction. That is, the second air volume V2 is an air volume smaller than the first air volume V1, which can prevent a stacked sheet from being pushed out due to a lower face of a discharge sheet, and in which a position (landing spot) of a discharge sheet in the sheet discharging direction becomes stable.

Figure 12:
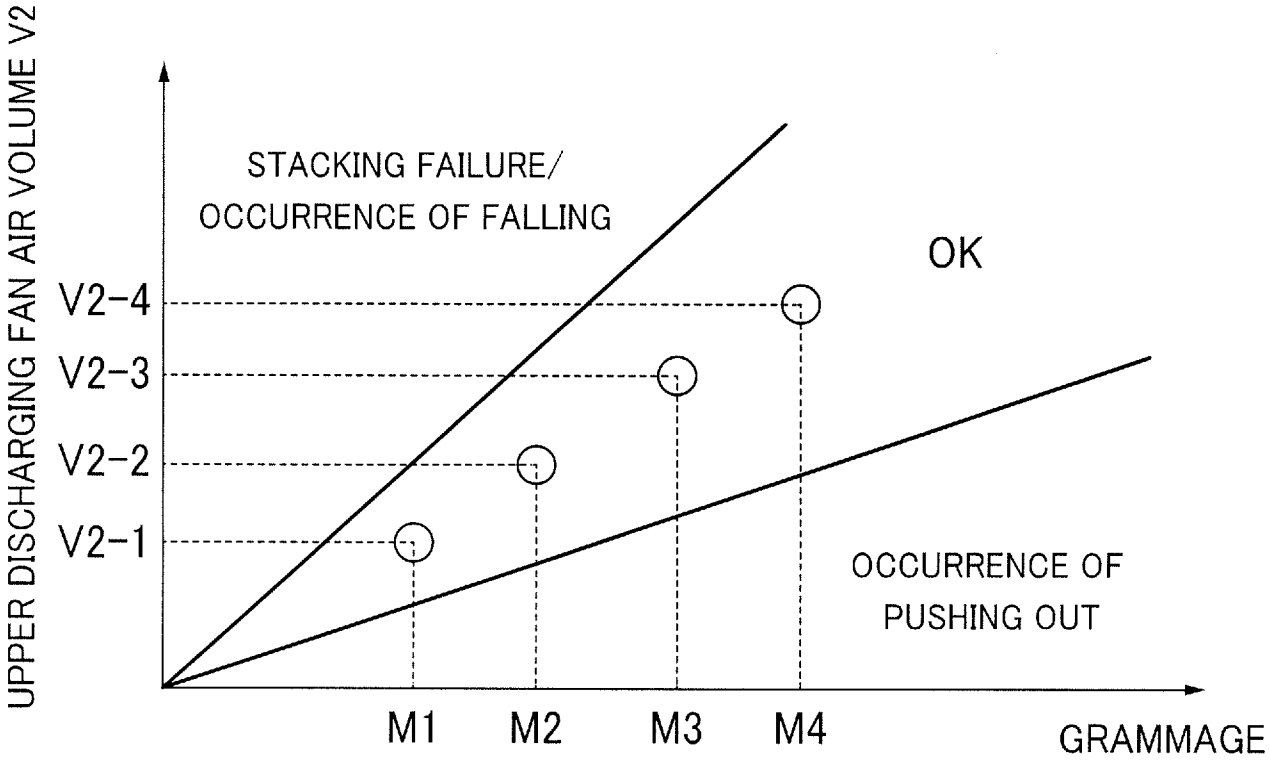
FIG. 12 is a graph illustrating a relationship between an air volume of the second air volume and a grammage of a sheet controlled by the fan control portion.

A detail of the second air volume V2 will be described, using FIG. 12. FIG. 12 illustrates a relationship between strength of the second air volume V2 and a grammage of the sheet S using a graph. For example, in a case of forming an image on the sheet with a small grammage such as the sheet with a grammage of M1, when an air volume of the second air volume V2 is excessively strong, a light sheet is hit by strong wind. For this reason, as illustrated in FIG. 12, there is a high possibility that a stacking performance decreases, and the sheet falls from the upper stacking tray 136.

For example, in a case of forming an image on the sheet with a large grammage such as the sheet with a grammage of M4, when strength of the second air volume V2 is excessively weak, a heavy sheet is hit by weak wind. For this reason, as illustrated in FIG. 12, there is a high possibility that a stacked sheet is pushed out due to friction μ between a lower face of a discharge sheet and a top face of the stacked sheet.

In this manner, it is necessary to set the second air volume V2 according to a grammage of the sheet on which an image is formed. Therefore, the fan control portion 712 is configured to change the second air volume V2 based on a grammage of the sheet in the sheet information of the sheet S which is input to the operating unit 601 as the input unit. In particular, in a case in which an image is formed on a plurality of sheets with a different grammage, as illustrated in FIG. 12, it is necessary to set a set value of the second air volume V2 for each grammage, like second air volumes V2-1 to V2-4 corresponding to grammage of M1 to M4. It is noted that it is better when the fan control portion 712 is configured to have a different set value in each of sheet types such as a plain sheet and a coated sheet, in addition to being configured to have the set value of the second air volume V2 for each grammage.

The fan control portion 712 performs a control by anticipating the second response time t2 which is necessary for switching, in order to switch the air volume blown by the upper discharging fan 60 from the second air volume V2 to the first air volume V1, before a leading end of the subsequent discharge sheet enters the nip portion N of the upper sheet discharge roller pair 120. That is, it is necessary for the fan control portion 712 to start the process in step S125 before elapsing of 300 ms, in a case in which a time between passing of the previous sheet through the nip portion N and reaching the nip portion N of the subsequent sheet is short, and productivity is high. According to the embodiment, it is possible to complete switching of an air volume before the leading end of the subsequent discharge sheet enters the nip portion N of the upper sheet discharge roller pair 120, by performing the process in step S125 after elapsing of 300 ms, after the trailing end of the sheet S entered the nip portion N of the upper sheet discharge roller pair 120. It is noted that, a process of aligning a stacked sheet in the direction of conveyance and the width direction performed in the above described steps S105 and S106 is performed between passing of the trailing end of the sheet S through the nip portion N of the upper sheet discharge roller pair 120 and elapsing of 300 ms.

After performing the process in step S125, the fan control portion 712 determines whether or not the sheet S which passed through the upper sheet discharge roller pair 120 in step S104 is the last sheet in the input job (step S126). In the process, the fan control portion 712 performs the same process as that in step S109 by the above described stacking tray control portion 711. In a case of determining that the sheet is not the last sheet (No in step S126), the fan control portion 712 returns the process to step S122. In a case of determining that the sheet is the last sheet (Yes in step S126), the fan control portion 712 finishes the process.

As described above, in the finisher 100 according to this disclosure, the fan control portion 712 performs a control of switching the air volume of the upper discharging fan 60 between the first air volume V1 and the second air volume V2 according to a position of the sheet S detected by the upper path detection sensor S17. For this reason, it is possible to prevent the sheet stacked on the upper stacking tray 136 from being pushed out to the downstream side of the sheet S in the sheet discharging direction, due to a leading end of the sheet S discharged by the upper sheet discharge roller pair 120, by performing air blowing with the first air volume V1. It is possible to prevent the sheet stacked on the upper stacking tray 136 from being pushed out due to a lower face of the sheet S being discharged by the upper sheet discharge roller pair 120, by causing the upper discharging fan 60 to blow the air with the second air volume V2. Since it is possible to prevent a landing spot of the sheet S stacked on the upper stacking tray 136 from being largely deviated to the downstream side in the sheet discharging direction, by blowing air with the second air volume V2 which is weaker than the first air volume V1, it is possible to stably stack the sheet S stacked on the upper stacking tray 136.

It is noted that, according to the embodiment, the fan control portion 712 performs a control so that the air volume blown by the upper discharging fan 60 is switched from the first air volume V1 to the second air volume V2, in a case in which the leading end of the sheet S is conveyed by L1 mm; however, it is not limited to this. In the finisher 100, if the upper discharging fan 60 blows the air with the first air volume V1 when the sheet S passes through the nip portion N of the upper sheet discharge roller pair 120, since the sheet S is nipped between the nip portion N, there is no influence on a stacking performance of the sheet S. For this reason, the fan control portion 712 may continue air blowing with the first air volume V1, even after the leading end of the sheet S is conveyed by L1 mm, and may perform a control so that an air volume is switched to the second air volume V2 immediately before the trailing end of the sheet S passes through the nip portion N. In a case in which an air volume is switched to the second air volume V2 immediately before the trailing end of the sheet S passes through the nip portion N, the finisher 100 can reliably prevent the stacked sheet from being pushed out to the downstream side in the sheet discharging direction due to the friction μ between a lower face of a discharge sheet and a top face of a stacked sheet.

According to the embodiment, the fan control portion 712 control the upper discharging fan 60 so as to start switching a volume of air from the second air volume V2 to the first air volume V1, in a case in which 300 ms has elapsed after the trailing end of the sheet S passed through the nip portion N; however, it is not limited to this. As described above, a process of aligning a stacked sheet in the direction of conveyance and the width direction performed in steps S105 and S106 (refer to FIG. 5) is performed during the time in which 300 ms elapses after the trailing end of the sheet S passed through the nip portion N. In a case in which the process of aligning the stacked sheet in the direction of conveyance and the width direction is performed, when considering a variation in behavior of the leading end of the sheet S due to an influence of air blowing, it is possible to easily move a stacked sheet to the upstream side in the sheet discharging direction when the air volume is small.

For this reason, the fan control portion 712 may continue air blowing with the second air volume V2, even after elapsing of 300 ms after the trailing end of the sheet S passed through the nip portion N, and may perform a control so that the air volume is switched to the first air volume V1 immediately before the leading end of the sheet S is conveyed to the nip portion N. In this case, the finisher 100 can further improve a stacking performance of the sheet stacked on the upper stacking tray 136, while preventing pushing out of the sheet stacked on the upper stacking tray 136 to the downstream side in the sheet discharging direction, due to a leading end of the sheet S.

Figure 13:
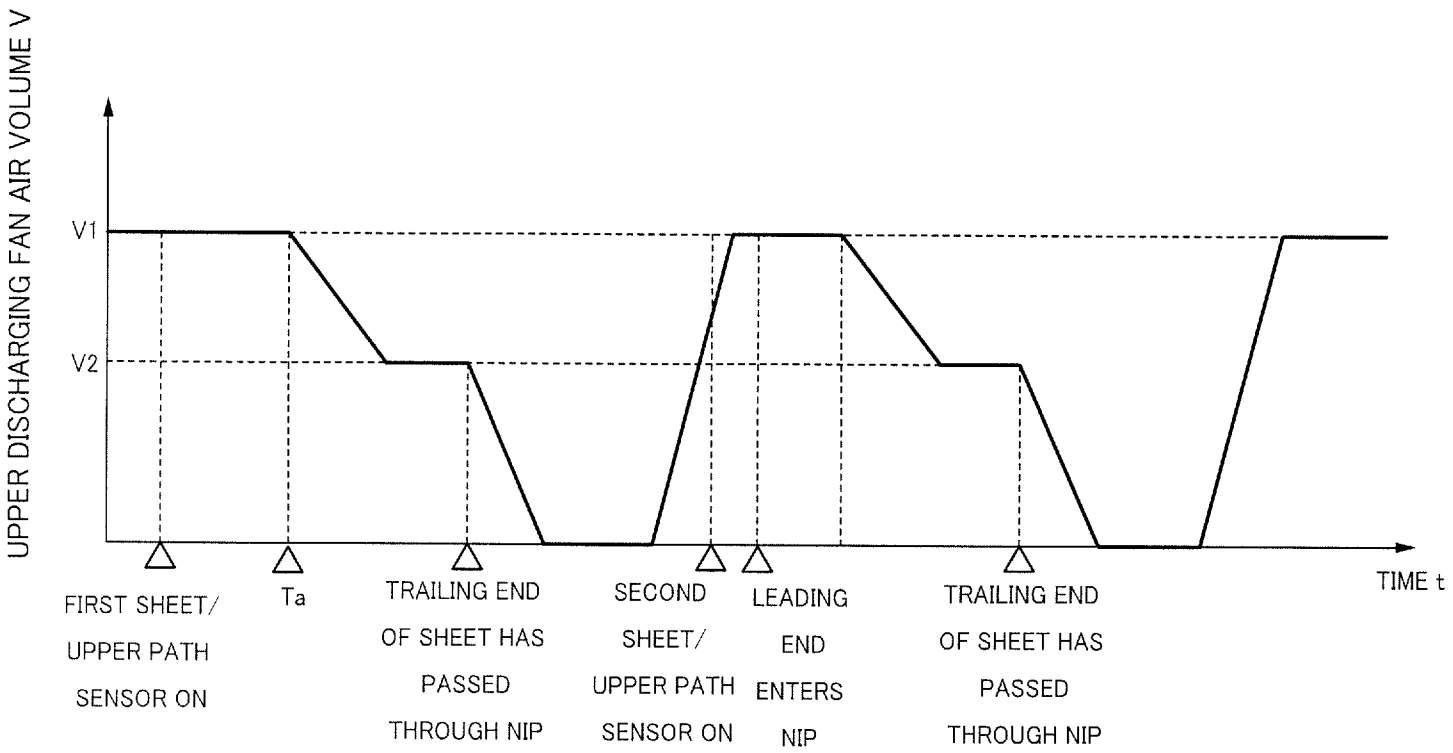
FIG. 13 is a graph illustrating a relationship between control of an air volume and time performed by the fan control portion in a modification example of the sheet stacking apparatus.

As illustrated in FIG. 13, the fan control portion 712 may be configured so that air blowing by the upper discharging fan 60 is stopped, after the trailing end of the sheet S passed through the nip portion N of the upper sheet discharge roller pair 120. It is noted that, in this case, it is necessary to complete switching of the air volume of the upper discharging fan 60 from zero to the first air volume V1 during the time in which a leading end of the subsequent sheet enters the nip portion N after the trailing end of the previous sheet passed through the nip portion N. For this reason, in order to set such a configuration, it is necessary to adopt a fan with extremely high responsivity, or it may be a case of low productivity.

According to the embodiment, the fan control portion 712 performs a control so that the air volume of the upper discharging fan 60 is switched between the first air volume V1 and the second air volume V2; however, it is not limited to this. As described above, the upper discharging fan 60 is configured to have low responsivity. In a case of the sheet S which is short in the direction of conveyance, like an A4 size sheet, a distance of the sheet S shifted to the downstream side in the sheet discharging direction when being discharged is not too long, even in air blowing with the first air volume V1.

For this reason, the fan control portion 712 discharges the sheet with the first air volume V1 without performing a control of switching the air volume, in a case in which a size of the sheet input from the operating unit 601 is a size of the sheet of which a length in the direction of conveyance is shorter than a predetermined size, like an A4 size. In a case of the sheet of which a length in the direction of conveyance is the predetermined size or more, like an A3 size sheet, a control of switching the air volume of the upper discharging fan 60 from the first air volume V1 to the second air volume V2 is performed in the middle of conveying the sheet by the upper sheet discharge roller pair 120. In this manner, the fan control portion 712 may be configured so that a determination on performing a control of switching the air volume of the upper discharging fan 60 is changed according to a size of the sheet S.

According to the embodiment, an operation of discharging a non-bound sheet to the upper stacking tray 136 has been described as a representative example; however, for example, it may be an operation of discharging a non-bound sheet to a lower stacking tray 137. In this case, it is necessary for the finisher 100 to provide a lower discharging fan similar to the upper discharging fan 60 in the lower stacking tray 137. This disclosure can be applied to an operation of discharging a stapled sheet, without limiting to a non-bound sheet.

According to the embodiment, the air volume toward a sheet is switched between the first air volume V1 and the second air volume V2 by changing a rotational speed of the upper discharging fan 60; however, it is not limited to this. For example, it may be a configuration in which a changing unit such as a diaphragm which changes an opening area of the vent 60*a* is provided, and the fan control portion 712 changes the opening area of the vent 60*a* by controlling the changing unit while setting a rotational speed of the upper discharging fan 60 to be constant, and switches the air volume toward the sheet between the first air volume V1 and the second air volume V2. It may be a configuration in which responsivity is further improved, by changing both the rotational speed of the upper discharging fan 60 and the opening area of the vent 60*a*.

Other Embodiments

Embodiments of this disclosure can also be realized by a computer of a system or apparatus that reads out and executes computer executable instructions recorded on a storage medium (e.g., non-transitory computer-readable storage medium) to perform the functions of one or more of the above-described embodiments of this disclosure, and by a method performed by the computer of the system or apparatus by, for example, reading out and executing the computer executable instructions from the storage medium to perform the functions of one or more of the above-described embodiments. The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While this disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2015-154275, filed Aug. 4, 2015, which is hereby incorporated by reference herein in its entirety.

What is claimed is:

1. A sheet stacking apparatus comprising:

a discharging portion comprising a nip portion nipping and conveying a sheet, and configured to discharge the sheet;

a stacking portion on which the sheet discharged by the discharging portion is stacked;

an air blowing unit configured to blow air toward a lower face of the sheet being nipped by the nip portion; and a control portion configured to execute a first mode in a case where a length of the sheet to be discharged by the discharging portion in a sheet discharging direction is a first length and a second mode in a case where a length of the sheet to be discharged by the discharging portion in the sheet discharging direction is a second length longer than the first length, the first mode being a mode where the air blowing unit does not change a volume of the air to the sheet while the nip portion of the discharging portion is nipping and conveying the sheet, and the second mode being a mode where the air blowing unit changes the volume of the air from a first air volume to a second air volume which is smaller than the first air volume while the nip portion of the discharging portion is nipping and conveying the sheet.

2. The sheet stacking apparatus according to claim 1, wherein the control portion controls the air blowing unit so as to blow the air to the sheet with the first air volume in a case where a leading end of the sheet discharged by the discharging portion passes through the nip portion in the second mode.

3. The sheet stacking apparatus according to claim 1, further comprising an abutment portion, disposed upstream of the stacking portion in the sheet discharging direction, against which a trailing end of the sheet discharged on the stacking portion abuts, wherein the stacking portion includes a first surface, and a second surface disposed upstream of the first surface in the sheet discharging direction and inclined downward toward the abutment portion, an inclination angle of the second surface with respect to a horizontal plane being larger than that of the first surface.

4. The sheet stacking apparatus according to claim 1, wherein the control portion controls the air blowing unit in a case where the discharging portion continuously discharges a proceeding sheet and a following sheet such that the air blowing unit has finished changing the volume of the air to the first air volume before a leading end of the following sheet is conveyed to the discharging portion in the second mode.

5. The sheet stacking apparatus according to claim 1, wherein the air blowing unit comprises a fan configured to rotate, and the control portion changes the volume of the air by changing a rotational speed of the fan in the second mode.

6. The sheet stacking apparatus according to claim 1, wherein the air blowing unit comprises a fan configured to rotate, a vent through which wind raised by the fan is blown to the sheet, and a changing unit which changes an opening area of the vent, and the control portion changes the volume of the air by changing the opening area of the vent by the changing unit.

7. The sheet stacking apparatus according to claim 1, wherein the control portion is configured to change the second air volume based on information related to the sheet to be discharged by the discharging portion in a case where a trailing end of the sheet passes the nip portion.

8. The sheet stacking apparatus according to claim 1, wherein the control portion is configured to change the second air volume based on a grammage of the sheet to be discharged by the discharging portion in a case where a trailing end of the sheet passes the nip portion.

9. The sheet stacking apparatus according to claim 1, further comprising:

a conveying path through which the sheet heading toward the discharging portion passes; and a first detection portion configured to detect a position of the sheet on the conveying path, wherein the control portion changes the volume of the air blown by the air blowing unit based on a detecting result of the first detection portion in the second mode.

10. The sheet stacking apparatus according to claim 1, wherein the air blowing unit blows the air along the sheet discharging direction between a lower face of the sheet nipped by the nip portion and an upper most sheet on the stacking portion.

11. The sheet stacking apparatus according to claim 1, further comprising a storage portion configured to store information of a length of the sheet to be discharged by the discharging portion in the sheet discharging direction, wherein the control portion executes one of the first mode and the second mode based on the length of the sheet stored in the storage portion.

12. The sheet stacking apparatus according to claim 1, further comprising:

an abutment portion against which a trailing end of the sheet discharged on the stacking portion abuts; and a rotating member configured to rotate and contact an upper most sheet on the stacking portion so as to make a trailing end of the upper most sheet abut against the abutment portion.

13. The sheet stacking apparatus according to claim 12, further comprising a moving portion configured to move the rotating member between a position where the rotating member contacts the upper most sheet and a position where the rotating member separates from the upper most sheet.

14. The sheet stacking apparatus according to claim 1, further comprising an alignment portion configured to move in a width direction orthogonal to the sheet discharging direction and perform an aligning operation of aligning the sheet stacked on the stacking portion in the width direction.

15. The sheet stacking apparatus according to claim 14, wherein the alignment portion is configured to perform the aligning operation in a case where the air blowing unit blows air.

16. The sheet stacking apparatus according to claim 1, further comprising:

an elevating portion configured to elevate the stacking portion; and a second detection portion configured to detect an upper most sheet stacked on the stacking portion, wherein the air blowing unit comprises a vent through which wind is blown, and wherein the elevating portion elevates the stacking portion based on a detection result of the second detection portion such that an upstream end of the upper most sheet, in the sheet discharging direction, stacked on the stacking portion is positioned below the vent.

17. A sheet stacking apparatus comprising:

a discharging portion comprising a nip portion nipping and conveying a sheet, and configured to discharge the sheet;

a stacking portion on which the sheet discharged by the discharging portion is stacked;

an air blowing unit comprising a rotatable fan and configured to blow air through a vent disposed below the nip portion, the air blown by the blowing unit through the vent flowing between the sheet nipped by the nip portion and an upper most sheet on the stacking portion; and a control portion configured to set a rotational speed of the fan at a constant speed while the nip portion of the discharging portion is nipping and conveying the sheet in a case where a length of the sheet to be discharged by the discharging portion in a sheet discharging direction is a first length, and to slow down a rotational speed of the fan while the nip portion of the discharging portion is nipping and conveying the sheet in a case where a length of the sheet to be discharged by the discharging portion in the sheet discharging direction is a second length longer than the first length.

18. The sheet stacking apparatus according to claim 17, further comprising:

an elevating portion configured to elevate the stacking portion; and a second detection portion configured to detect an upper most sheet stacked on the stacking portion, wherein the elevating portion elevates the stacking portion based on the detection result of the second detection portion such that an upstream end of the upper most sheet, in the sheet discharging direction, stacked on the stacking portion is positioned below the vent.

19. A image forming apparatus comprising:

an image forming portion configured to form an image on a sheet; and a sheet stacking apparatus comprising:

a discharging portion comprising a nip portion nipping and conveying the sheet on which the image is formed by the image forming portion, and configured to discharge the sheet;

a stacking portion on which the sheet discharged by the discharging portion is stacked;

an air blowing unit configured to blow air toward a lower face of the sheet being nipped by the nip portion; and a control portion configured to execute a first mode in a case where a length of the sheet to be discharged by the discharging portion in a sheet discharging direction is a first length and a second mode in a case where a length of the sheet to be discharged by the discharging portion in the sheet discharging direction is a second length longer than the first length, the first mode being a mode where the air blowing unit does not change a volume of the air to the sheet while the nip portion of the discharging portion is nipping and conveying the sheet, the second mode being a mode where the air blowing unit changes the volume of the air from a first air volume to a second air volume which is smaller than the first air volume while the nip portion of the discharging portion is nipping and conveying the sheet.

* * * * *